US009995550B2

(12) United States Patent
Shelton et al.

(10) Patent No.: US 9,995,550 B2
(45) Date of Patent: Jun. 12, 2018

(54) FIREARM SLIDE WITH AN INTEGRATED FLASH HIDER

(71) Applicant: AGENCY ARMS, LLC, Camarillo, CA (US)

(72) Inventors: Derek Hunter Shelton, Claremore, OK (US); Randy Paul Niswander, Oxnard, CA (US); Michael Lee Parks, Canyon Country, CA (US)

(73) Assignee: AGENCY ARMS, LLC, Ventura, CA (US)

( * ) Notice: Subject to any disclaimer, the term of this patent is extended or adjusted under 35 U.S.C. 154(b) by 0 days. days.

(21) Appl. No.: 15/402,532

(22) Filed: Jan. 10, 2017

(65) Prior Publication Data

US 2017/0299315 A1 Oct. 19, 2017

Related U.S. Application Data

(60) Provisional application No. 62/279,311, filed on Jan. 15, 2016, provisional application No. 62/394,437, filed on Sep. 14, 2016.

(51) Int. Cl.
*F41A 21/00* (2006.01)
*F41A 21/34* (2006.01)
*F41A 3/66* (2006.01)

(52) U.S. Cl.
CPC ..... *F41A 21/34* (2013.01); *F41A 3/66* (2013.01)

(58) Field of Classification Search
USPC ..... 89/14.2, 14.3, 198
See application file for complete search history.

(56) References Cited

U.S. PATENT DOCUMENTS

| | | | | | |
|---|---|---|---|---|---|
| 2,581,395 | A * | 1/1952 | Elfstrom | F41A 3/86 | 89/14.3 |
| 2,935,000 | A * | 5/1960 | Mowrey | F41A 21/325 | 89/14.3 |
| 4,207,799 | A * | 6/1980 | Tocco | F41A 21/325 | 89/14.3 |
| 4,691,614 | A * | 9/1987 | Leffel | F41A 21/36 | 89/14.3 |
| 4,709,497 | A * | 12/1987 | Resca | F41A 21/32 | 42/7 |
| 4,811,648 | A * | 3/1989 | Blackwell | F41A 21/36 | 89/14.3 |
| 4,930,397 | A * | 6/1990 | Seidler | F41A 21/325 | 89/14.3 |
| 5,123,328 | A * | 6/1992 | Schuemann | F41A 21/28 | 89/14.3 |
| 5,549,030 | A * | 8/1996 | Lespron | F41A 21/36 | 89/14.3 |
| 6,604,445 | B2 * | 8/2003 | Sevastian | F41A 21/36 | 42/1.06 |
| 7,328,645 | B1 * | 2/2008 | Curry | F41A 21/28 | 42/1.06 |
| 7,748,306 | B1 * | 7/2010 | Curry | F41A 21/28 | 42/1.06 |
| 2014/0075800 | A1 * | 3/2014 | Morris, Jr. | F41A 21/36 | 42/1.06 |

* cited by examiner

*Primary Examiner* — Samir Abdosh
(74) *Attorney, Agent, or Firm* — Eversheds Sutherland (US) LLP

(57) ABSTRACT

A firearm slide is disclosed. The firearm may include a slide and a flash hider integrally formed into an end of the slide.

16 Claims, 11 Drawing Sheets

FIREARM SLIDE WITH AN INTEGRATED FLASH HIDER

CROSS-REFERENCE TO RELATED APPLICATIONS

The disclosure claims priority to and the benefit of U.S. provisional application No. 62/279,311, filed Jan. 15, 2016, which is herein incorporated by reference in its entirety.

The disclosure claims priority to and the benefit of U.S. provisional application No. 62/394,437, filed Sep. 14, 2016, which is herein incorporated by reference in its entirety.

FIELD

The disclosure generally relates to firearms and more particularly relates to a firearm slide with an integrated flash hider.

BACKGROUND

A flash suppressor, also known as a flash hider, is a firearm accessory that can be attached to a muzzle of a barrel to reduce the visible flash associated with firing the firearm. Flash suppressors reduce, or in some cases eliminate, the flash by rapidly cooling the gases as they leave the muzzle of the barrel.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Figure 1:
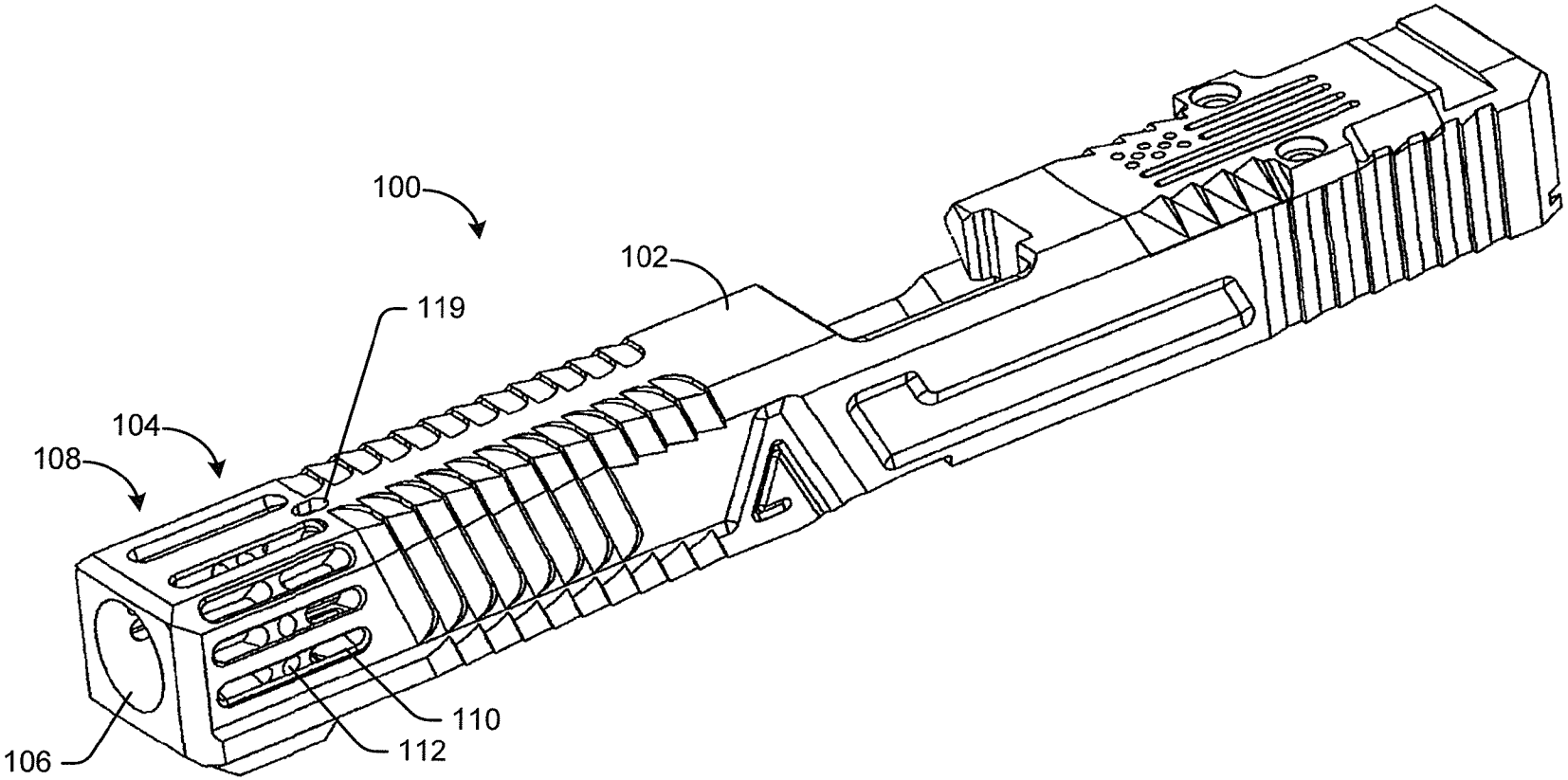
FIG. 1 depicts an upper perspective view of a firearm slide in accordance with one or more embodiments of the disclosure.

Described below are embodiments of a firearm slide (as well as individual components of the firearm slide) that can be attached to a firearm. Methods of installing the firearm slide on the firearm are also disclosed. The firearm slide may be attached to a conventional firearm. For example, the firearm slide may be used with a handgun or the like. Any firearm may be used. The firearm slide may be configured to reduce the muzzle jump, muzzle recoil, muzzle blast, and/or muzzle flash generated by the firing of the firearm by slowing, expanding, trapping, and/or cooling the propellant gases associated with the firing of the firearm.

The firearm slide may include a slide with a flash hider integrally formed into an end of the slide. The flash hider may include a bore forming an internal cavity and a plurality of ports in communication with the bore. The plurality of ports may comprise elongated axial slots, elongated radial holes, or a combination thereof. In some instances, at least some of the ports may be angled to accommodate spinning propellant gases exiting the flash hider. In addition, the flash hider may include internal ribs.

These and other embodiments of the disclosure will be described in more detail through reference to the accompanying drawings in the detailed description of the disclosure that follows. This brief introduction, including section titles and corresponding summaries, is provided for the reader's convenience and is not intended to limit the scope of the claims or the proceeding sections. Furthermore, the techniques described above and below may be implemented in a number of ways and in a number of contexts. Several example implementations and contexts are provided with reference to the following figures, as described below in more detail. However, the following implementations and contexts are but a few of many.

FIGS. 1-5 schematically depict a firearm slide 100. The firearm slide 100 may include a slide 102. The slide 102 may be any size, shape, or configuration. The slide 102 may be attached to a firearm, such as a handgun or the like. The slide 102 may be attached to any firearm. A flash hider 104 may be integrally formed into an end of the slide 102. That is, the flash hider 104 and the slide 102 may be a single piece. In this manner, unlike conventional flash hiders, the flash hider 104 is not attached to the muzzle end of a barrel. Instead, the flash hider 104 is connected to and formed together with the slide 102. In some instances, the flash hider 104 may be a separate component that is attachable to the slide 102.

The flash hider 104 may be any size, shape, or configuration. The flash hider 104 may include a bore 106 and a plurality of ports 108 in communication with the bore 106. The plurality of ports 108 may comprise elongated axial slots 110, elongated radial holes 112, or a combination thereof. For example, the elongated radial holes 112 may be disposed within the elongated axial slots 110. The axial slots 110 may be disposed on the sides and top of the slide 102. The axial slots 110 may be generally parallel to a longitudinal axis of the bore 106. The radial holes 112 may be generally perpendicular to the bore axis. Any number of ports 108 may be used herein. The ports 108 may be any size, shape, or configuration.

Figure 2A:
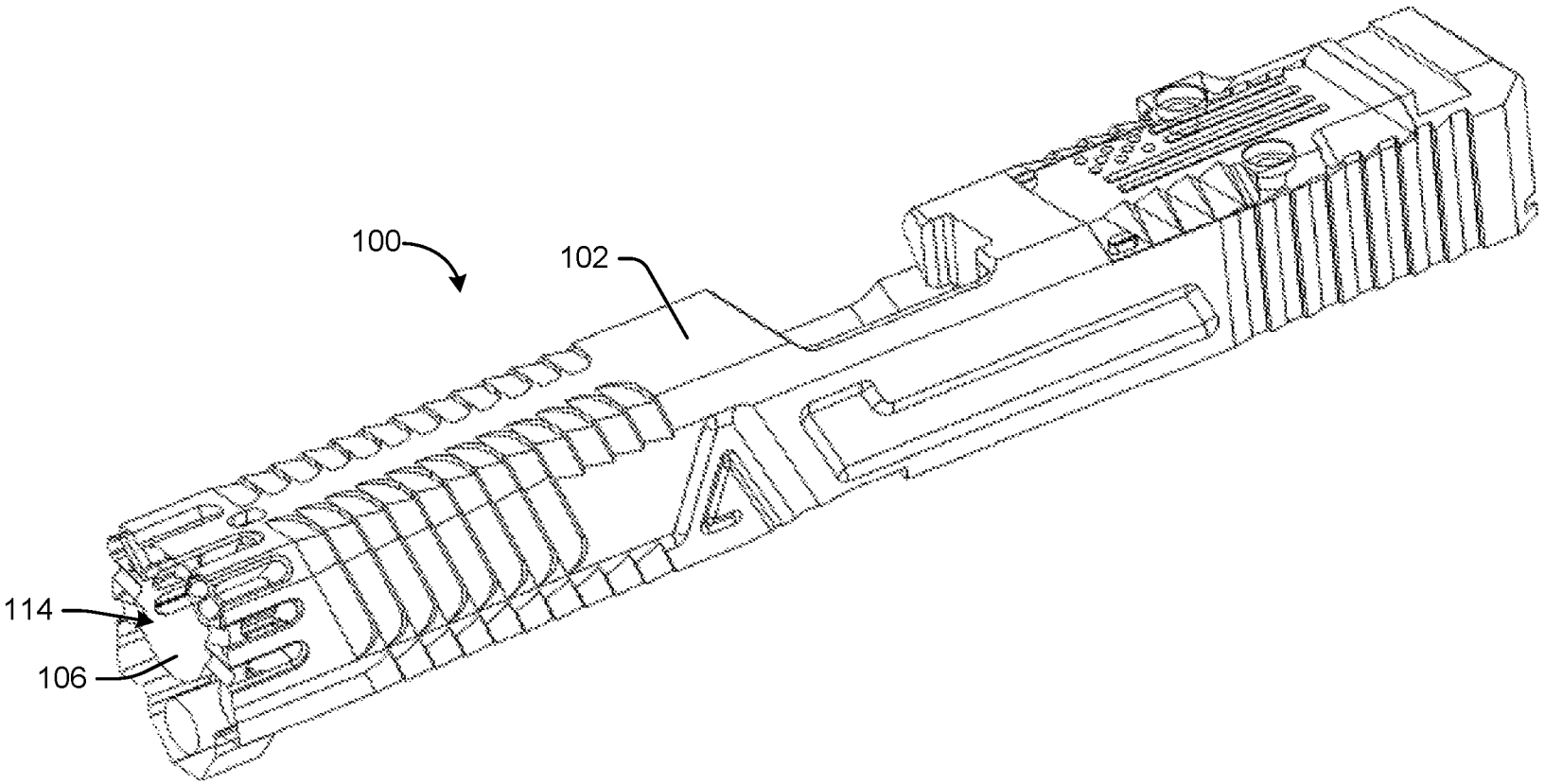
FIG. 2A depicts a cross-sectional view of a portion of a firearm slide in accordance with one or more embodiments of the disclosure.
Figure 2B:
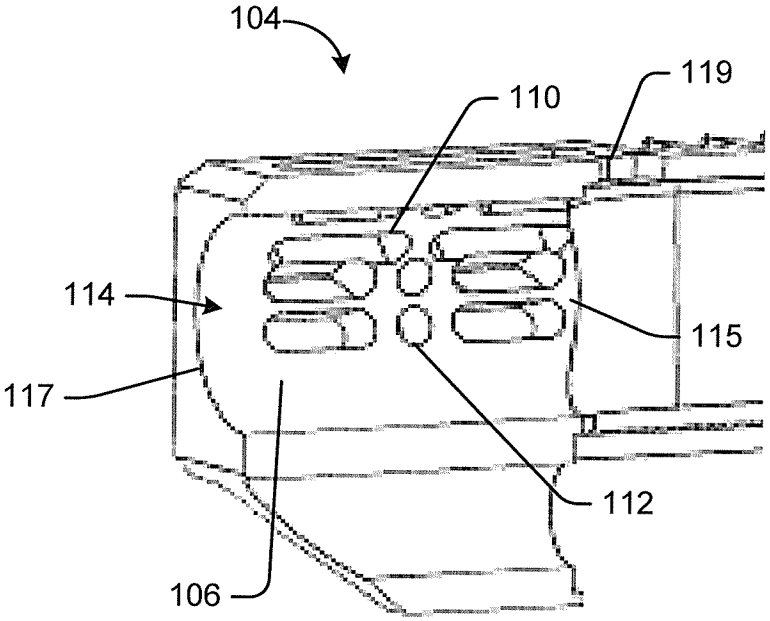
FIG. 2B depicts a cross-sectional view of a portion of a firearm slide in accordance with one or more embodiments of the disclosure.
Figure 3:
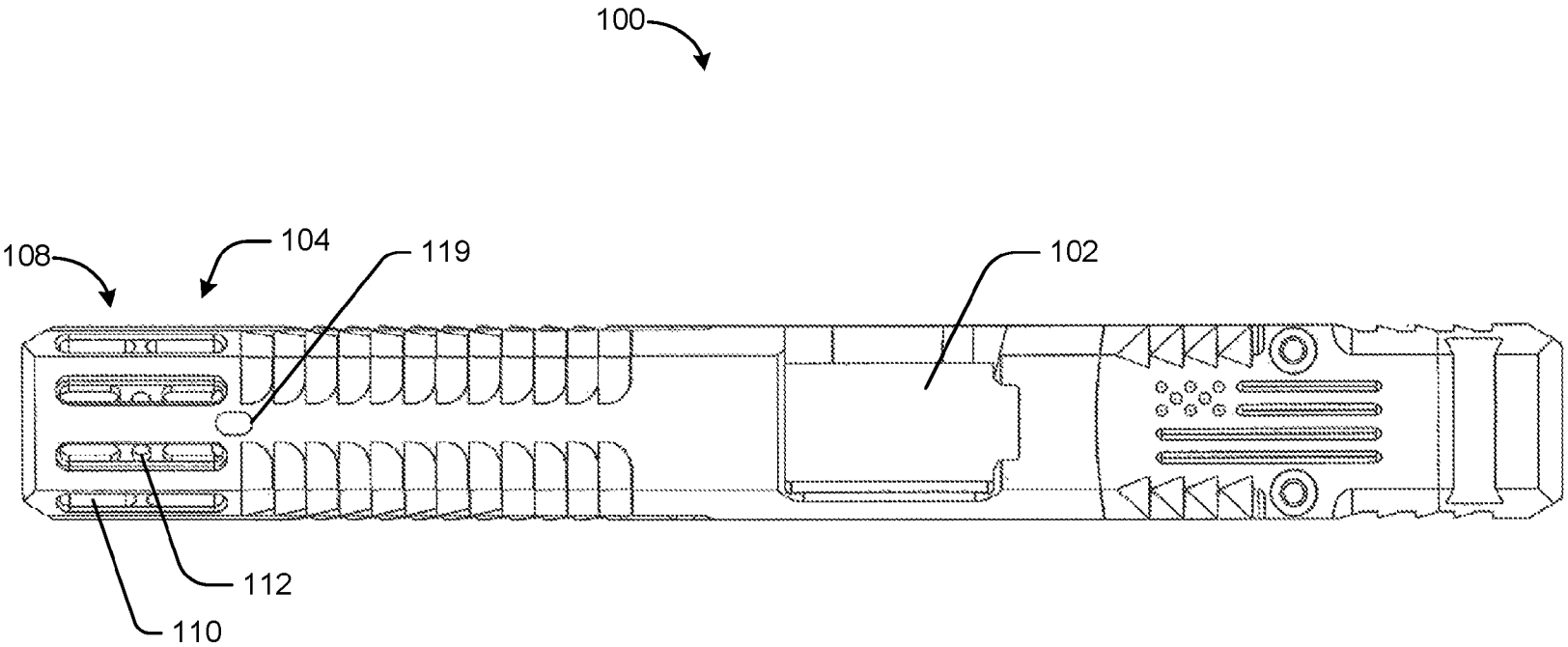
FIG. 3 depicts a top view of a firearm slide in accordance with one or more embodiments of the disclosure.
Figure 4:
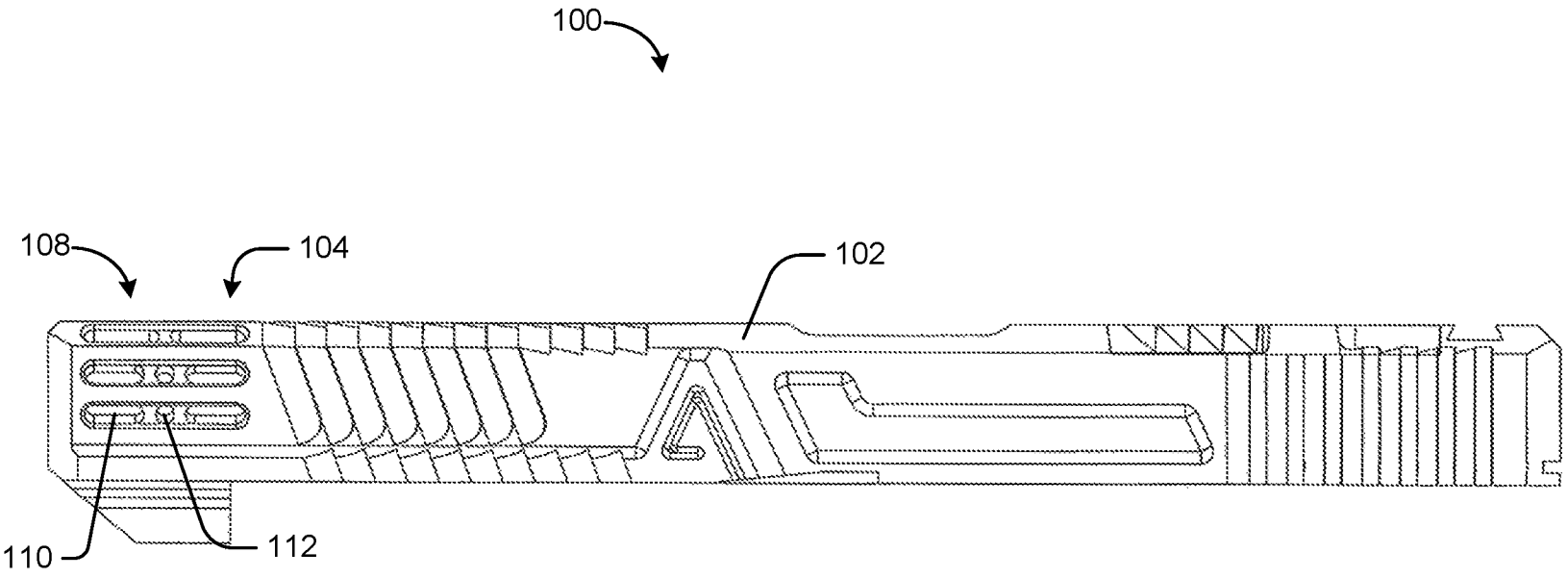
FIG. 4 depicts a side view of a firearm slide in accordance with one or more embodiments of the disclosure.
Figure 5:
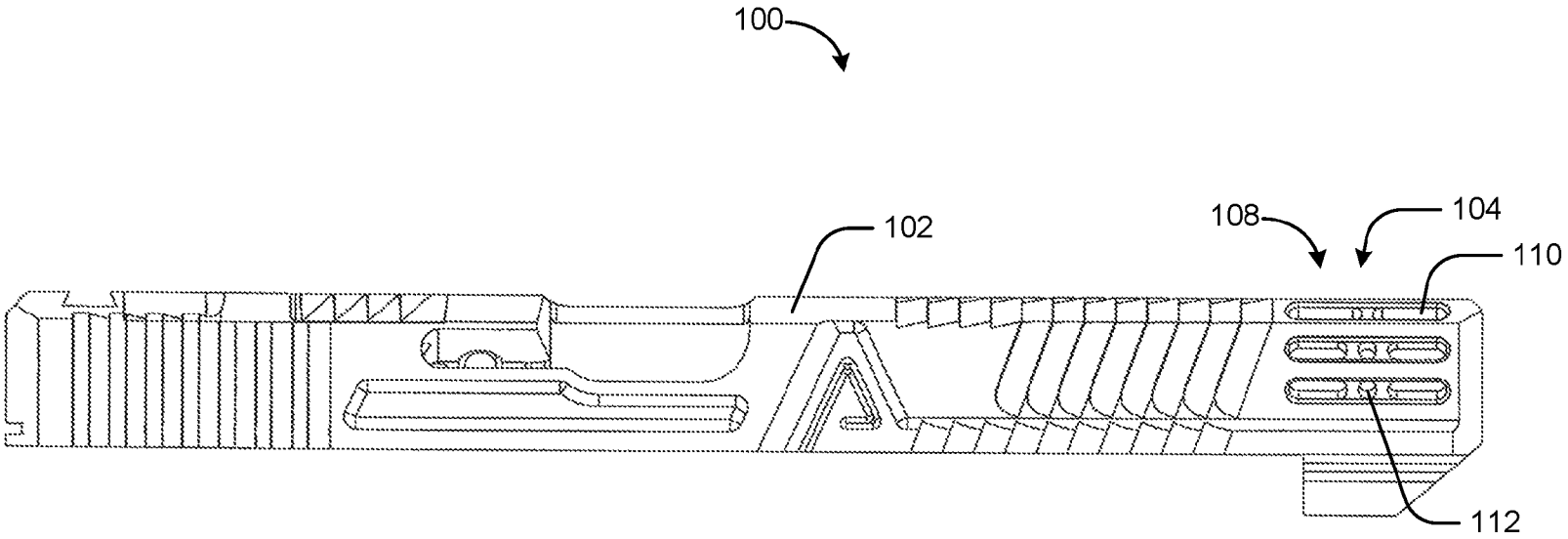
FIG. 5 depicts a side view of a firearm slide in accordance with one or more embodiments of the disclosure.

In certain embodiments, as depicted in FIGS. 2A and 2B, the bore 106 may form an internal chamber 114 of the flash hider 104. In some instances, a muzzle end of a barrel of the firearm may be disposed adjacent to but not within a first end 115 of the internal chamber 114 before the firearm is discharged. In other instances, the muzzle end of the barrel may partially extend into the first end 115 of the internal chamber 114 before the firearm is discharged. That is, there may be a slight overlap of the muzzle end of the barrel and the first end 115 of the internal chamber 114 before the firearm is discharged. In some instances, the muzzle end of the barrel may "float" within the first end 115 of the internal chamber 114 before the firearm is discharged. In other instances, the muzzle end of the barrel may rest against the first end 115 of the internal chamber 114 before the firearm is discharged. The first end 115 may comprise a substantially circular hole. In this manner, the barrel of the firearm may extend into the internal chamber 114 after the firearm has been discharged. In some instances, the muzzle end of the barrel may extend beyond the internal chamber 114 after the firearm has been discharged. In some instances, an inner diameter of the bore 106 may expand outward towards a second end 117 of the internal chamber 114 from the first end of the internal chamber 114 to accommodate the barrel entering the internal chamber 114. In one example embodiment, the second end 117 may comprise a substantially circular hole, which may have a larger diameter than the hole of the first end 115. In other instances, the inner diameter of the bore 106 may be constant from the first end 115 to the second end 117 of the internal chamber. In some instances, the inner diameter of the bore 106 may vary to accommodate the barrel entering and exiting the internal chamber 114 as the firearm is discharged. The internal chamber 114 may be any size, shape, or configuration.

Referring back to FIGS. 1 and 3, the slide 102 may include a front sight hole 119. In some instances, the front sight hole 119 may extend at least partially between two of the elongated axial slots 110. In other instances, the front sigh hole 119 may be disposed to the rear of the internal chamber 114. That is, as depicted in FIG. 2B, the front sight hole 119 may be located to the rear of the first end 115 of the internal chamber 114. The front sight 119 may be any size, shape, or configuration.

FIGS. 6-10 schematically depict a firearm slide 200. The firearm slide 200 may include a slide 202. The slide 202 may be any size, shape, or configuration. The slide 202 may be attached to a firearm, such as a handgun or the like. The slide 202 may be attached to any firearm. A flash hider 204 may be integrally formed into an end of the slide 202. That is, the flash hider 204 and the slide 202 may be a single piece. In this manner, unlike conventional flash hiders, the flash hider 204 is not attached to the muzzle end of a barrel. Instead, the flash hider 204 is connected to and formed together with the slide 202. In some instances, the flash hider 204 may be a separate component that is attachable to the slide 202.

The flash hider 204 may be any size, shape, or configuration. The flash hider 204 may include a tapered end. In addition, the flash hider 204 may include a bore 206 and a plurality of ports 208 in communication with the bore 206. The plurality of ports 208 may comprise elongated slots 210, holes 212, or a combination thereof. Any number of ports 208 may be used herein. The ports 208 may be any size, shape, or configuration. In one example embodiment, the elongated slots 210 may be disposed on the side of the slide 202, and the holes 212 may be disposed on top of the slide 202.

Figure 8:
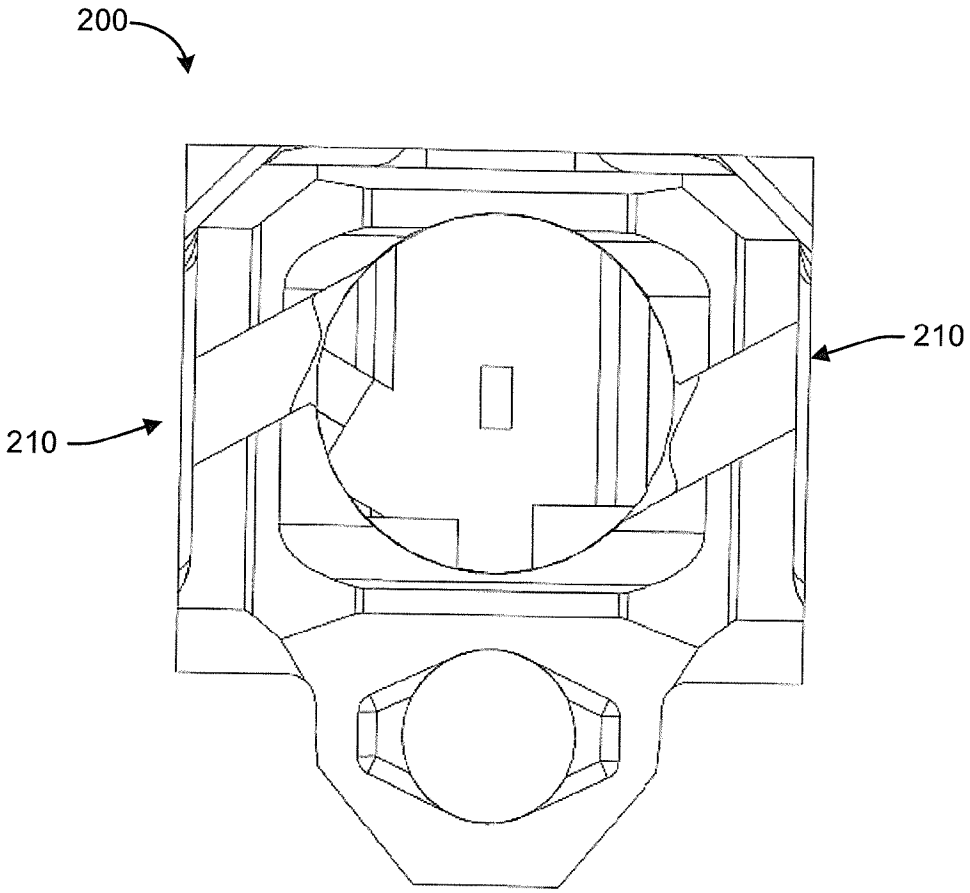
FIG. 8 depicts a front view of a firearm slide in accordance with one or more embodiments of the disclosure.
Figure 9:
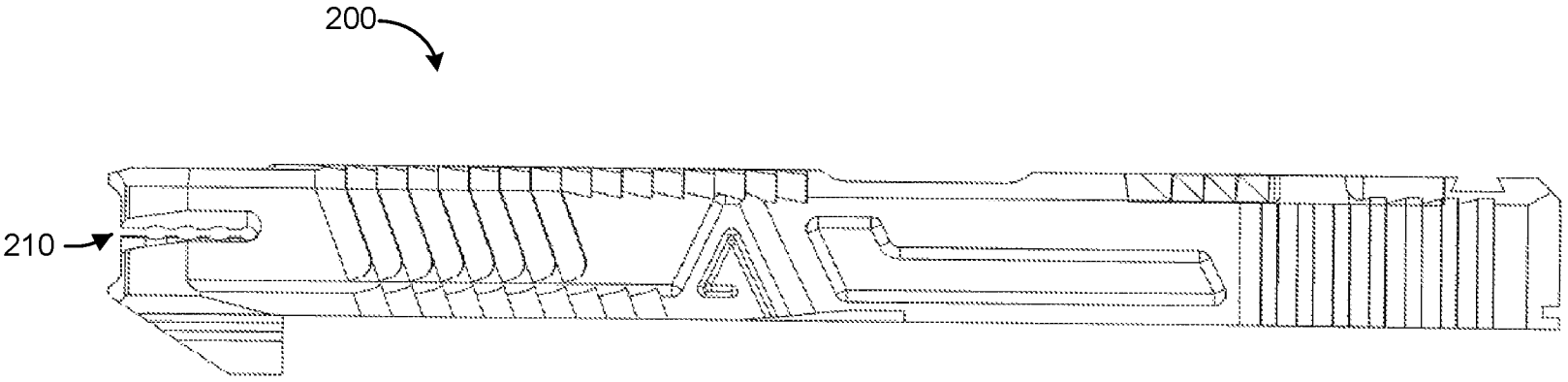
FIG. 9 depicts a side view of a firearm slide in accordance with one or more embodiments of the disclosure.

As depicted in FIG. 8, the elongated slots 210 may be angled to accommodate the spinning propellant gases exiting the flash hider 204. That is, due to the rifling in the barrel of the firearm, the bullet spins as is exits the barrel. The spinning bullet and rifling causes the propellant gases exiting the barrel to spin as well. To further slow, expand, trap, and/or cool the propellant gases associated with the firing of the firearm, the elongated ports 210 are angled. That is, the elongated slots 210 are angled offset from the longitudinal axis of the bore 206 such that the elongated slots 210 do not extend radial outward from the longitudinal axis of the bore 206. For example, as depicted in FIG. 8, when looking at the slide 202 from the front, the elongated slots 210 are angled relative to the horizontal plane. In some instances, the elongated slots 210 on both side of the slide 202 are disposed at the same but opposite angle. For example, an elongated slot 210 on a first side of the slide 202 may be angled upward, while an elongated slot 210 on an opposite second side of the slide 202 may be angled downward. In addition, as depicted in FIG. 9, the forward portion of the elongated slots 210 may be angled downward relative to the horizontal plane.

Figure 7:
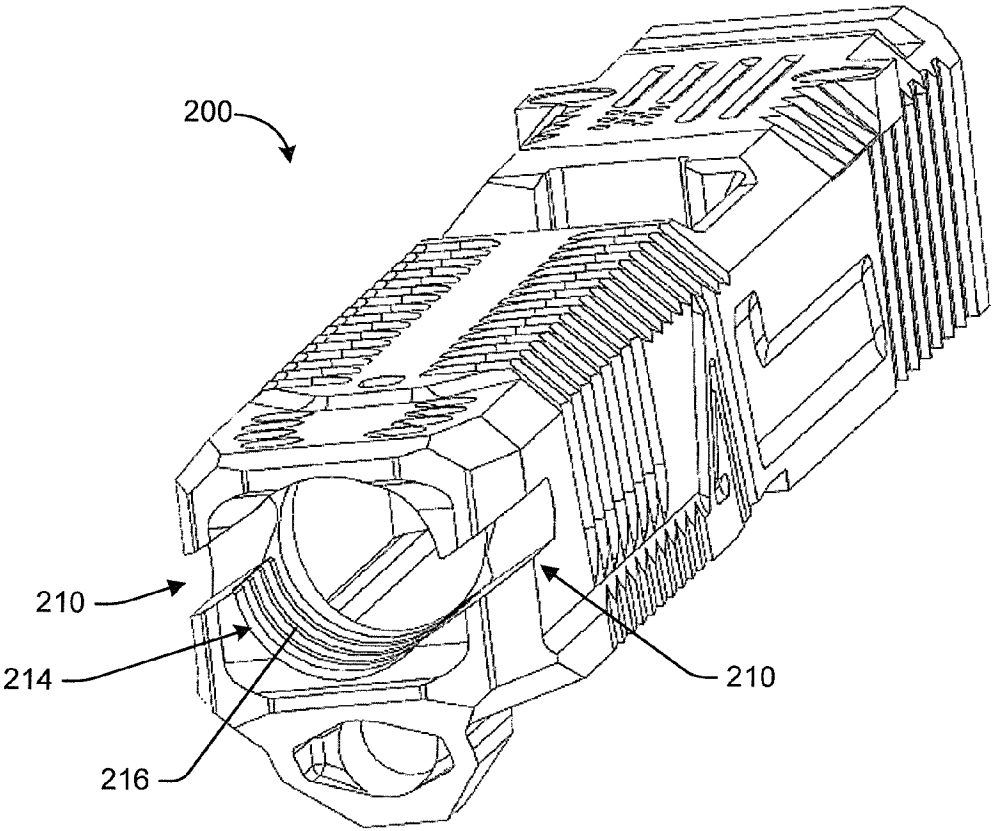
FIG. 7 depicts an upper perspective view of a firearm slide in accordance with one or more embodiments of the disclosure.

As depicted in FIG. 7, in some instances, the bore 206 may include internal ribs 216. The ribs 216 may comprise circumferential ribs about the internal surface of the bore 206. Any number of ribs 216 may be used. In some instances, a number of axially spaced ribs 216 may be used. In other instances, a single spiral shaped rib 216 may be disposed within the bore 206. The ribs 216 may be any size, shape, or configuration.

Figure 10:
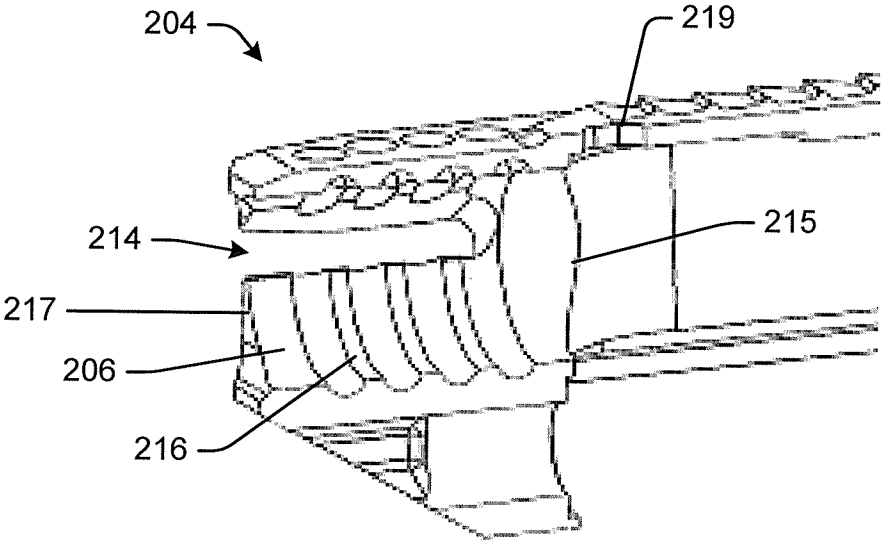
FIG. 10 depicts a cross-sectional view of a portion of a firearm slide in accordance with one or more embodiments of the disclosure.

In certain embodiments, as depicted in FIG. 10, the bore 206 may form an internal chamber 214 of the flash hider 204. In some instances, a muzzle end of a barrel of the firearm may be disposed adjacent to but not within a first end 215 of the internal chamber 214 before the firearm is discharged. In other instances, the muzzle end of the barrel may partially extend into the first end 215 of the internal chamber 214 before the firearm is discharged. That is, there may be a slight overlap of the muzzle end of the barrel and the first end 215 of the internal chamber 214 before the firearm is discharged. In some instances, the muzzle end of the barrel may "float" within the first end 215 of the internal chamber 214 before the firearm is discharged. In other instances, the muzzle end of the barrel may rest against the first end 215 of the internal chamber 214 before the firearm is discharged. The first end 215 may comprise a substantially circular hole. In this manner, the barrel of the firearm may extend into the internal chamber 214 after the firearm has been discharged. In some instances, the muzzle end of the barrel may extend beyond the internal chamber 214 after the firearm has been discharged. In some instances, an inner diameter of the bore 206 may expand outward towards a second end 217 of the internal chamber 214 from the first end of the internal chamber 214 to accommodate the barrel entering the internal chamber 214. In one example embodiment, the second end 217 may comprise a substantially circular hole, which may have a larger diameter than the hole of the first end 215. In other instances, the inner diameter of the bore 206 may be constant from the first end 215 to the second end 217 of the internal chamber. In some instances, the inner diameter of the bore 206 may vary to accommodate the barrel entering and exiting the internal chamber 214 as the firearm is discharged. The internal chamber 214 may be any size, shape, or configuration.

Figure 6:
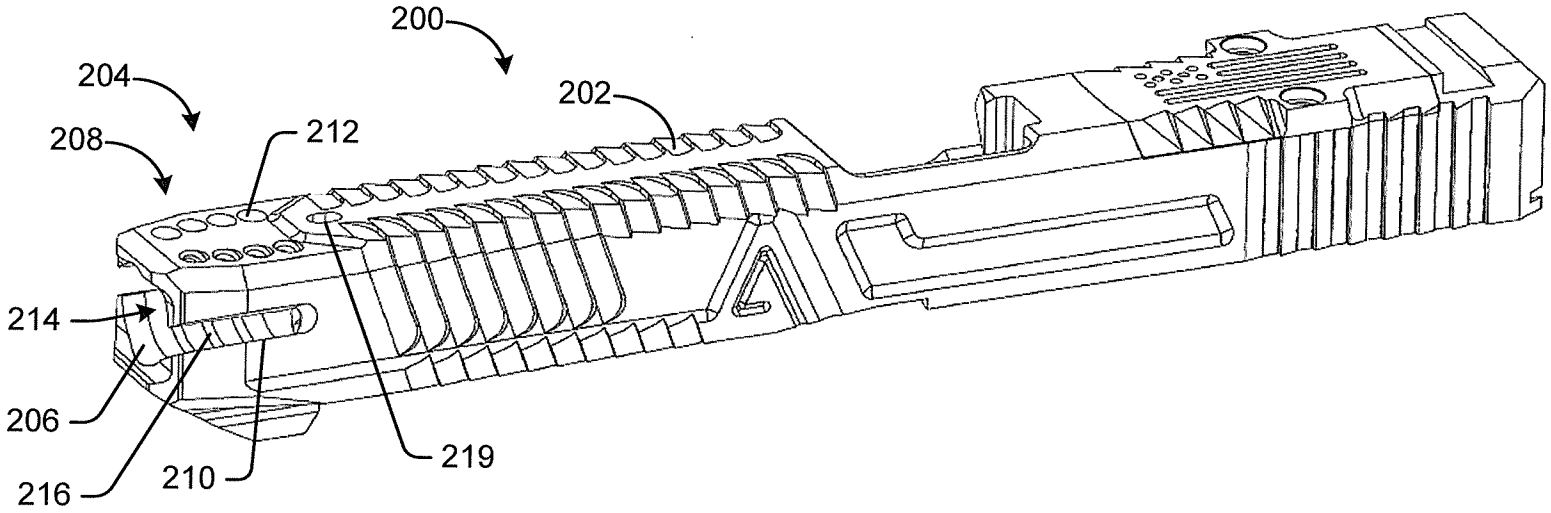
FIG. 6 depicts an upper perspective view of a firearm slide in accordance with one or more embodiments of the disclosure.

Referring to FIGS. 6 and 10, the slide 202 may include a front sight hole 219. In some instances, the front sigh hole 119 may be disposed to the rear of the internal chamber 214. That is, as depicted in FIG. 10, the front sight hole 119 may be located to the rear of the first end 215 of the internal chamber 214. The front sight 219 may be any size, shape, or configuration.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A firearm slide for a firearm, comprising:

a slide; and a flash hider integrally formed into an end of the slide, wherein the flash hider comprises a bore forming an internal cavity, and wherein a barrel extends into the bore after the firearm ha been discharged.

2. The firearm slide of claim 1, wherein the flash hider comprises a plurality of ports in communication with the bore.

3. The firearm slide of claim 2, wherein the plurality of ports comprises elongated axial slots.

4. The firearm slide of claim 3, wherein the elongated axial slots are angled.

5. The firearm slide of claim 2, wherein the plurality of ports comprises elongated radial holes.

6. The firearm slide of claim 1, wherein a muzzle end of the barrel is disposed adjacent to the bore before the firearm is discharged.

7. The firearm slide of claim 1, wherein an inner diameter of the bore expands outward towards the end of the slide.

8. The firearm slide of claim 1, wherein a muzzle end of the barrel is disposed adjacent to a first end of the internal chamber before the firearm is discharged.

9. The firearm slide of claim 1, further comprising a front sight hole disposed in the slide.

10. The firearm slide of claim 1, further comprising a plurality of ribs disposed within the bore.

11. A firearm slide, comprising:

a slide; and a flash hider integrally formed into an end of the slide, wherein the flash hider comprises, a first elongated slot angled downward and disposed on a first side of the slide; and a second elongated slot angled upward and disposed on a second side of the slide.

12. The firearm slide of claim 11, wherein a forward portion of the first and second elongated slots is angled downward.

13. The firearm slide of claim 11, further comprising internal ribs disposed within the flash hider.

14. A firearm slide for a firearm, comprising:

a slide; and a flash hider integrally formed into an end of the slide, wherein the flash hider comprises a bore forming an internal cavity, wherein a muzzle end of a barrel is disposed adjacent to a first end of the internal chamber before the firearm is discharged, and wherein the barrel extends into the internal chamber after the firearm has been discharged.

15. A firearm slide, comprising:

a slide;

a flash hider integrally formed into an end of the slide; and a front sight hole disposed in the slide.

16. A firearm slide, comprising:

a slide;

a flash hider integrally formed into an end of the slide, wherein the flash hider comprises a bore forming an internal cavity; and a plurality of ribs disposed within the bore.

* * * * *